United States Patent [19]

Badke

[11] 4,346,898

[45] Aug. 31, 1982

[54] PUTTING GOLF BALL

[76] Inventor: Frank C. Badke, 1617 Riverside, McDade Estates, Conroe, Tex. 77301

[21] Appl. No.: 55,507

[22] Filed: Jul. 9, 1979

Related U.S. Application Data

[63] Continuation-in-part of Ser. No. 935,904, Aug. 23, 1978, abandoned.

[51] Int. Cl.[3] ..... A63B 37/14

[52] U.S. Cl. ..... 273/232; 40/327

[58] Field of Search ..... 273/232, 62, 183 C, 273/213, 233; 40/327

[56] References Cited

U.S. PATENT DOCUMENTS

| | | | |
|---|---|---|---|
| 878,254 | 2/1908 | Taylor | 273/232 |
| 4,090,716 | 5/1978 | Martin et al. | 273/232 |
| 4,142,727 | 3/1979 | Shaw et al. | 273/232 |

FOREIGN PATENT DOCUMENTS

| | | | |
|---|---|---|---|
| 24667 | of 1897 | United Kingdom | 273/232 |

OTHER PUBLICATIONS

"Washington Star", Apr. 25, 1909, 273–62.

"Capital City Federal Homeowner", Jul.–Aug. 1972, published by Capital City Federal Savings & Loan Association of Washington, D.C.

"The Curious History of the Golf Ball, Mankinds Most Fascinating Sphere", by John Stuart Martin, Horizon Press, New York, pp. 127–130.

*Primary Examiner*—George J. Marlo

*Attorney, Agent, or Firm*—Kenneth H. Johnson

[57] ABSTRACT

A putting golf ball having concave depressions of 0.08 inch to 0.02 inch surface diameter, 0.002 to 0.014 inch depth, covering 20 to 90% of the surface of the ball.

7 Claims, 2 Drawing Figures

PUTTING GOLF BALL

This application is a continuation-in-part of Ser. No. 935,904 filed Aug. 23, 1978, now abandoned.

BACKGROUND OF THE INVENTION

This invention relates to the accuracy of a golf ball to be used for putting. More specifically, the present invention relates to a golf ball having improved putting accuracy.

Golf balls used for the game of golf are designed with individual depressions of sufficient size and golf ball circumferential width to aerodynamically assist the travel distance and accuracy of the golf ball flight.

The golf balls with these aerodynamically designed depressions are also used for putting.

Suitable putting tests with golf balls of this size and circumferential width depressions have shown putting inaccuracies with an angle of deviation of the resultant line of the putted golf ball motion direction from the putter line of motion direction.

The tests have also shown that the inaccuracy, or angle of deviation, of the resultant putted golf ball motion direction to the putter line of motion direction is greater with a decrease of the putter-applied force to the golf ball.

Suitable equipment was developed and used for these golf ball putting tests. A simple observation test can be performed by dropping a golf ball onto a level, smooth surface plate, and observing the golf ball bounce return angle of deviation from the verticle fall line of the dropped golf ball to the surface plate.

The surface of golf balls is compressive. The compressive resistance area of contact to the golf ball from the putter's force is proportional in size to the putter force applied. When the putter force to the golf ball is decreased, the putter-to-golf-ball surface contact area size is also decreased.

A low putter force compression into the golf ball surface will produce a small area of golf ball surface resistance to the putter contact force. This small golf ball surface contact area center of resistance can be more on the extreme edge of the golf ball depression, which can be more off the center line of the putting stroke direction to the center of the golf ball mass that will produce an inaccuracy, or deviation, of the resultant line of the golf ball motion direction from the putter's line of motion direction.

A greater putter force compression into the golf ball surface will produce a larger area of golf ball surface resistance to the putter contact force. This larger area can be the result of compression of more of the golf ball surface depression edge, which will locate the area center of golf ball compression resistance more toward the center line of the putting stroke direction to the center of the golf ball mass. This larger compression area will produce a smaller inaccuracy, or smaller angle of deviation of the resultant line of the putted golf ball motion direction from the putter's line of motion direction, as compared with a smaller putter force that will result with a smaller compression contact area of the golf ball surface.

In accordance with Newton's Second Law of Motion, an unbalanced force acting on a body causes an acceleration of the body in the direction of the force of magnitude proportional to the force and inversely to the mass of the body. It is almost impossible for a golf player to position a golf ball so that the putter will accurately strike the golf ball surface depressions in balance with the putter line of direction through the center of the ball, hence the most likely result of a putt is a deviation from the line of the stroke.

Briefly stated, this invention is an improvement of the golf ball to be used for putting, that will more accurately and consistently position the putter force to the golf ball surface contact area center point of resistance in line with the putting stroke direction to the center of the mass.

It is an advantage of the present invention that the deviations observable with ordinary golf balls are reduced by the present golf ball. It is a feature of the present invention that the usual feel and appearance of an ordinary golf ball is preserved as well as some of the aerodynamic properties of ordinary golf balls. These and other advantages and features will be apparent from the following description.

SUMMARY OF THE INVENTION

Briefly, the invention is a substantially spherical golf ball having a plurality of surface depressions spaced over the surface thereof, each of said depressions having a surface diameter in the range of 0.02 inches to 0.08 inches. The depth of the depression will play a role in the retention of desirable aerodynamic flight characteristics, and will generally be the same as those currently in use or up to about 0.04 inches, but would best be no deeper than about 0.014 inches at the deepest point, since the smallness of the depression surface diameter would make the removal of dirt and mud difficult.

DETAILED DESCRIPTION OF THE INVENTION

To investigate golf ball putting characteristics, an apparatus was devised to provide constant and reproducible putter swings. Briefly, the apparatus consists of a vertical frame with a hinged putter component mounted therein. The putter component was a pair of rigid members, shafts affixed to a plate at the top, which is pivotally mounted in the frame, and a smooth metal plate at the lower end which serves as the putter head. The length of the stroke of the putter head is adjustable by a adjustable bracket against which the putter head is seated and held on the rearward stroke. The putter head is held in place by an electromagnet, which when deactivated frees the putter to swing forward and strike the golf ball. The force applied on each swing is that of gravity at the particular bracket position.

The golf balls were positioned in a small rubber "0" ring attached to a horizontal putting surface. The putting surface used for the evaluations was smooth glass. A smooth steel plate was positioned a fixed distance from the "0" ring on the putting surface perpendicular to the putter stroke line. A sheet of paper was placed over this plate facing the putter and a sheet of carbon paper was placed over this.

The evaluations were made by placing a particular golf ball in the "0" ring and putting it at given back stroke a number of times. The putted ball would strike the carbon paper and mark the paper below. It was determined that for any given golf ball, the longer the putting stroke, i.e., greater compressive force, a smaller deviation in the path of the ball from the line of the stroke was obtained. The variation for golf ball observed at any stroke length was found to be directly related to the surface diameter of the depressions of the ball.

It has been calculated for various surface diameter that the maximum deviation of a putted golf ball at a minimum stroke force to propel the ball 3 feet would be:

| SURFACE WIDTH OF SURFACE DEPRESSION (average) Inches | MAXIMUM DEVIATION AT 3 FEET (RIGHT OR LEFT FROM LINE OF STROKE) |
|---|---|
| 0.020 | 0.42 |
| 0.080 | 1.71 |
| 0.106 | 2.27 |
| 0.110 | 2.35 |
| 0.120 | 2.57 |
| 0.125 | 2.65 |
| 0.135 | 2.87 |
| 0.140 | 3.00 |
| 0.150 | 3.21 |

Figure 1:
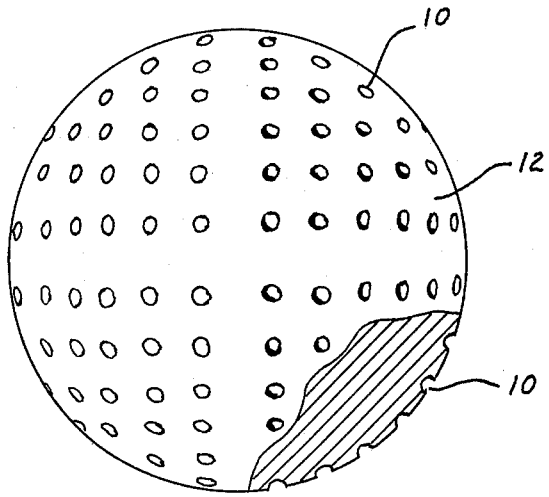
FIG. 1 is a perspective of a golf ball with a partial cross sectional view.

In FIG. 1, the small or relatively small depressions 10 on the surface of a golf ball 12 are illustrated. The shape of the depression may be round, i.e., a spheroid, square, hexagon, octagon or irregular. The depressions may vary within the range described or may be of a uniform size. They may be irregularly placed over the balls surface or may be uniformly or evenly distributed. Regardless of the depression shape, the surface dimensions will fall in the recited range. The spacing of depressions may be over the surface, that is, there may be a substantial area of the surface of the ball upon which there are no depressions or the depressions may be placed very close together to substantially cover the surface with only slight ridges between depressions. The depression may cover from 20 to 90% of the surface area of the ball, more preferably about 40 to 80% thereof.

The golf ball's inner elastic balls, hollow centers, solid centers, liquid filled centers, with elastic winding. The cover is of a tough polymeric material as known in the art.

Figure 2:
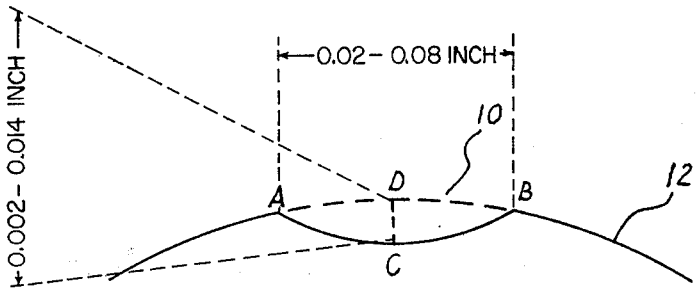
FIG. 2 is an enlarged cross sectional view of one depression on the present golf ball.

The depression may be stamped on the surface of the ball or cast thereon. FIG. 2 shows a portion of the surface of a golf ball, enlarged to show one depression 10 having sloped sides and a surface diameter AB in the range of 0.08 inch to 0.02 inch and a depth CD of no greater than 0.014 inch up to a depth which will cause the depression to be little more than a surface decoration but generally not less than 0.002 inch.

The depressions are primarily present as aerodynamic elements of the golf ball. A smooth, depression free ball would be best for putting, but such a ball would not drive well. Hence, the present invention seeks to maintain some degree of aerodynamic properties and to provide a better putting ball. It is also necessary to maintain some surface depression to present a golf ball which is acceptable to golfers. A smooth ball would appear as a table tennis ball and not have acceptance for golf play, whether of the ordinary or minature variety.

Hence, the invention lies in the inventor's choice of these depression sizes and arrangements for the reason stated above.

The invention claimed is:

1. A putting golf ball having a plurality of concave surface depressions over the surface thereof, each of said depressions having a surface diameter in the range of 0.020 inches to 0.080 inches having improved line of putting stroke accuracy.

2. The putting golf ball according to claim 1 wherein the depth of each depression is in the range of 0.002 to 0.014 inch.

3. The putting golf ball according to claim 2 wherein said depressions cover from 20 to 90% of the surface area of the ball.

4. The putting golf ball according to claim 3 wherein said depressions cover from 40 to 80% of the surface area of the ball.

5. The putting golf ball according to claim 2 wherein said depressions have a substantially uniform size and depth and are evenly spaced over 20 to 90% of the surface of the ball.

6. The putting golf ball according to claim 5 wherein said depressions are substantially uniform in shape.

7. The putting golf ball according to claim 6 wherein the depressions are spheroid.

* * * * *